United States Patent [19]

Partanen et al.

[11] Patent Number: 4,687,110

[45] Date of Patent: Aug. 18, 1987

[54] APPARATUS FOR ANGULARLY DISPLACING A LOAD

[75] Inventors: Paavo Partanen, Hyvinkää ; Soini Söderena, Korpi, both of Finland

[73] Assignee: Elevator GmbH, Baar, Switzerland

[21] Appl. No.: 903,880

[22] Filed: Sep. 2, 1986

Related U.S. Application Data

[63] Continuation of Ser. No. 721,453, Apr. 9, 1985, abandoned.

[30] Foreign Application Priority Data

Apr. 9, 1984 [FI] Finland ..... 841398

[51] Int. Cl.[4] ..... B66C 17/00

[52] U.S. Cl. ..... 212/147; 212/213

[58] Field of Search ..... 212/146-148, 212/205-221

[56] References Cited

U.S. PATENT DOCUMENTS

| | | | |
|---|---|---|---|
| 3,825,128 | 7/1974 | Cooper | 212/147 |
| 3,887,080 | 6/1975 | Wilson | 212/212 |
| 4,531,647 | 7/1985 | Higuchi et al. | 212/147 |

FOREIGN PATENT DOCUMENTS

| | | | |
|---|---|---|---|
| 2146226 | 7/1976 | Fed. Rep. of Germany | 212/147 |
| 102130 | 8/1980 | Fed. Rep. of Germany | 212/147 |
| 3030330 | 2/1982 | Fed. Rep. of Germany | 212/148 |
| 68035 | 3/1985 | Finland | 212/147 |
| 17249 | 2/1979 | Japan | 212/147 |
| 1542821 | 3/1979 | United Kingdom | 212/147 |

*Primary Examiner*—Joseph F. Peters, Jr.
*Assistant Examiner*—Stephen P. Avila

[57] ABSTRACT

An apparatus for angularly displacing and/or moving a load suspended by ropes, comprising a lifting carriage frame running along a girder carried on running wheels, and rope sheaves for the lifting ropes. In lifting and transporting apparatus of prior art, fine adjustment of the load position was not possible. The problem has been solved with the aid of this invention in that the frame carries a running surface for each rope sheave set, and that the rope sheaves can be moved either together or separately with a separate moving machinery.

6 Claims, 7 Drawing Figures

APPARATUS FOR ANGULARLY DISPLACING A LOAD

This application is a continuation of application Ser. No. 721,453, filed Apr. 9, 1985, now abandoned.

BACKGROUND OF THE INVENTION

The present invention concerns an apparatus for angularly displacing and/or moving a load suspended by ropes, said apparatus comprising a lifting trolley frame running along a girder, supported by running wheels, and of rope sheaves for the lifting ropes.

The drawback encumbering hoisting means of this type is that the load tends to swing owing to inertia forces or strong wind. In addition, it is not possible in these means to displace the load angularly, not even a small amount. In order to counteract oscillation, suspension systems have been developed which are based on changing the rope base in that the load is carried on the jib of the crane by two carriages running on tracks, their mutual distance being changeable and causing, when required, a large enough horizontal component in the support for stopping the swing.

The Patent DE-2146226 discloses a means of this kind, where the movement with relation to each other of the carriages has been implemented by means of a screw connecting them. Furthermore, the maximum distance between the carriages has been limited with a frame of framing encircling them.

In the Finnish patent application No. 821436, freedom of the load from oscillation has been arranged with two drive means, one of them reducing and the other increasing the distance between the sets of rope sheaves.

However, the drawback of these types of apparatus is that the sets of rope sheaves can only be moved towards each other or away from each other, but not in the same direction. For this reason, fine regulation of the load position is not feasible. But this would frequently be desirable, particularly when loading a ship, in which case the cargo hatch may be narrow.

SUMMARY OF THE INVENTION

The object of the present invention is to eliminate the shortcoming mentioned above. The apparatus of the invention is characterized in that the frame has a running surface for each set of rope sheaves, and that the rope sheaves can be moved, either separately or together, using a separate moving machinery. Hereby the advantage is gained that by suitably moving each set of rope sheaves the load can be turned through a few degrees in desired direction. Furthermore, the advantage is gained that the load can be moved a short distance while the carriage is stationary. This is advantageous e.g. when loading a lorry.

An advantageous embodiment of the invention is characterized in that the apparatus comprises four separate sets of rope sheaves, these sets being provided with running wheels which roll along travelling surfaces when the sets of rope sheaves are being moved by means of power cylinders installed between them and the frame of the lifting carriage and which constitute the moving machinery. This is a simple solution and one which is reliable in operation.

Another advantageour embodiment of the invention is characterized in that the apparatus has its own separate moving machinery for each set of rope sheaves and that the moving machineries can be coupled together so that the desired moving of the load, or result of turning, is achieved.

The invention is described in the following in greater detail with the aid of an example with reference to the attached drawings.

DETAILED DESCRIPTION OF THE PREFERRED EMBODIMENTS

Figure 1:
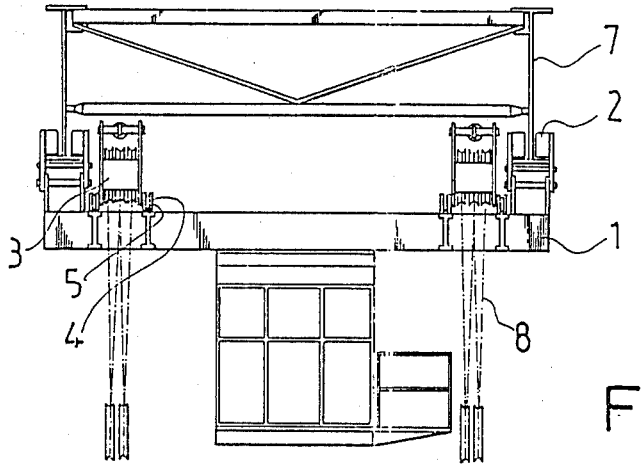
FIG. 1 presents an apparatus according to the invention, viewed from the front.
Figure 2:
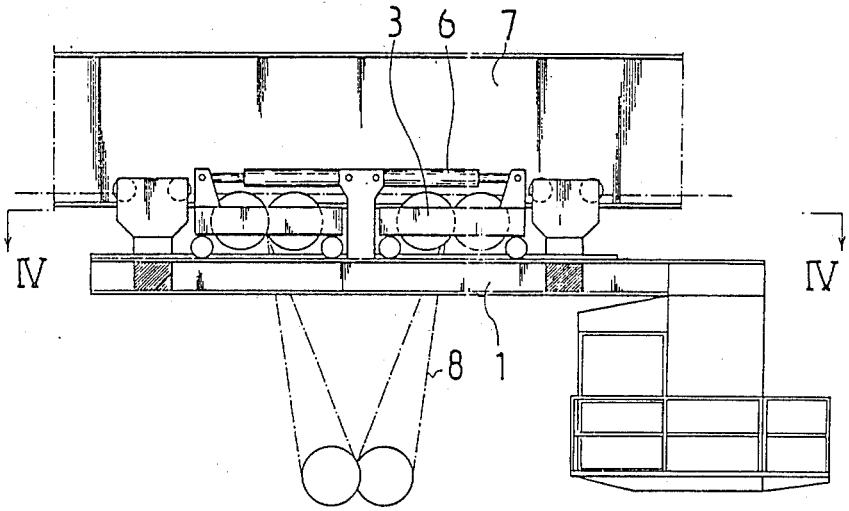
FIG. 2 shows the section along line II—II in FIG. 4, in the position with indrawn rope sheave sets.

The apparatus comprises a carriage frame 1, which runs along a girder 7 in the load's travelling direction, carried by running wheels 2. The carriage structure comprises running tracks 5, on which four separate rope sheave sets 3, which move carried by running wheels 4. Each set of rope sheaves is moved with a separate moving machinery, in this case a power cylinder 6. The spacing of the rope sheave sets is normally the largest possible, whereby the lifting ropes 8 can be given a large enough inclination relative to the vertical, which will prevent oscillations of the load. When the load is lowered into a cramped space, e.g. in a ship's hold, it is possible with the machinery 6 to run the rope sheave sets inward, thereby enabling the load to be lowered into a cramped space without incurring damage to the ropes.

Figure 5:
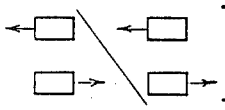
Figure 6:
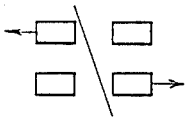
Figure 7:
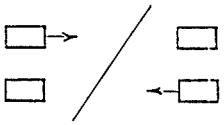
Figure 3:
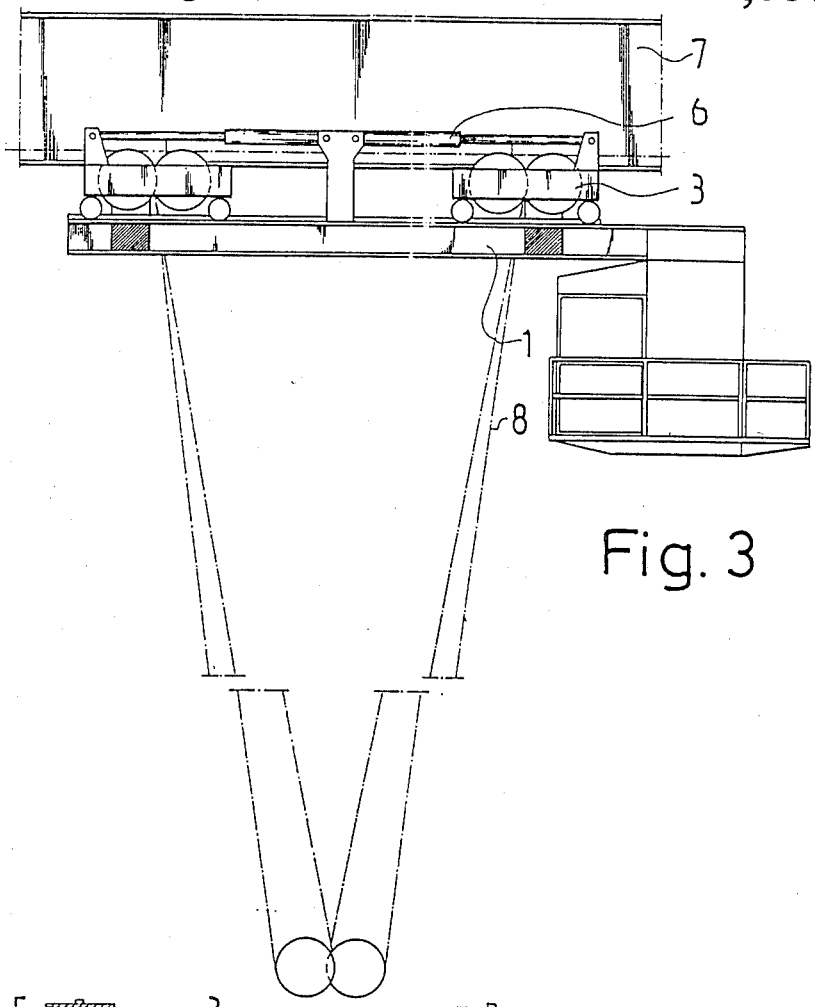
FIG. 3 shows the same as FIG. 2, but with the rope sheaves in pushed-out position.
Figure 4:
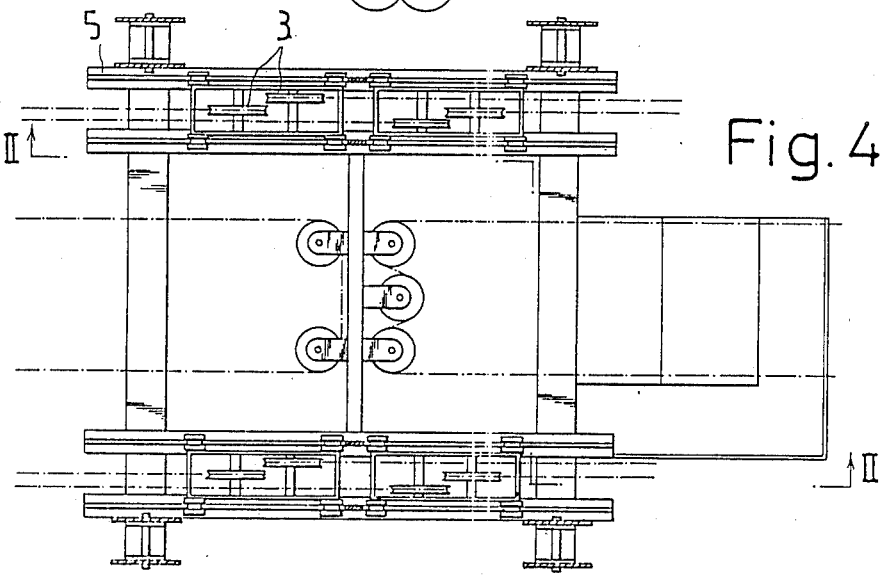
FIG. 4 shows the section along line IV—IV in FIG. 2, FIG. 5 schematically illustrates the turning of the load when the rope sheave sets are in center position, and FIGS. 6 and 7 schematically illustrate the turning of the load when the rope sheave sets are in their inner or outer positions.

Angular displacement of a container is accomplished in the manner illustrated by FIGS. 5–7, depending on in which position the rope sheave sets are in the particular instance. If they are in their center positions, turning is accomplished by running the rope sheave sets on different sides in different directions, as shown in FIG. 5. Similarly, if they are in their inner or outer positions, turning is accomplished by running crosswise those rope sheave sets which have a chance to move crosswise.

It is obvious to a person skilled in the art that for moving the rope sheave sets not only hydraulic cylinders but also a screw machinery or a rack-and-pinion machinery may be used. The rope sheave sets may also run along sliding surfaces. It is also obvious that different embodiments of the invention are not confined merely to the example presented and may rather vary with the scope of the claims following below.

What is claimed is:

1. Apparatus for angularly displacing and/or moving a load suspended by ropes, including a lifting carriage frame running along a girder and carried on running wheels, lifting ropes carried by the carriage frame, and sets of rope sheaves for the lifting ropes, said apparatus comprising:

a running surface on said frame for each rope sheave set, and means for selectively moving the rope sheave sets separately.

2. Apparatus according to claim 1, wherein four separate rope sheave sets are provided with each having running wheels rolling along travelling surfaces when the rope sheave sets are moved, said moving means comprising power cylinders mounted between the sheave sets and the lifting carriage frame.

3. Apparatus according to claim 1, wherein a separate moving means is provided for each rope sheave set and the moving means may be coupled so that desired movement or angular displacement of the load is achieved.

4. In apparatus for angularly displacing and/or moving a load suspended by ropes, the apparatus including a lifting carriage frame supported for movement along a girder, lifting ropes carried by the lifting carriage frame, and rope sheaves for the lifting ropes, the improvement comprising:

said rope sheaves being provided on opposite sides of said carriage frame as a plurality of sets of sheave pairs, each of said sets being mounted for movement along said opposite sides of said carriage frame, and means for separately and independently moving each set of said plurality of sets along respective sides of said carriage frame.

5. The improvement of claim 4, wherein said moving means comprise power cylinder means coupled between each set and said carriage frame.

6. The improvement of claim 4, and further including means for selectively coupling said moving means to achieve a desired movement or angular displacement of the load.

* * * * *